US010253592B2

(12) United States Patent
Ingram et al.

(10) Patent No.: US 10,253,592 B2
(45) Date of Patent: Apr. 9, 2019

(54) ANTI-EXTRUSION BARRIER FOR PACKING ELEMENT

(71) Applicant: Weatherford Technology Holdings, LLC, Houston, TX (US)

(72) Inventors: Gary Duron Ingram, Houston, TX (US); Simon J. Harrall, Houston, TX (US)

(73) Assignee: Weatherford Technology Holdings, LLC, Houston, TX (US)

( * ) Notice: Subject to any disclaimer, the term of this patent is extended or adjusted under 35 U.S.C. 154(b) by 244 days.

(21) Appl. No.: 15/171,671

(22) Filed: Jun. 2, 2016

(65) Prior Publication Data

US 2017/0350211 A1 Dec. 7, 2017

(51) Int. Cl.
*E21B 33/128* (2006.01)
*E21B 33/12* (2006.01)
*E21B 33/134* (2006.01)

(52) U.S. Cl.
CPC ..... *E21B 33/128* (2013.01); *E21B 33/1216* (2013.01); *E21B 33/134* (2013.01)

(58) Field of Classification Search
CPC ..... E21B 33/128; E21B 33/134
See application file for complete search history.

(56) References Cited

U.S. PATENT DOCUMENTS 4,094,280 A * 6/1978 Updike ..... F01L 1/32 123/90.3
4,509,763 A 4/1985 Fischer
4,809,989 A 3/1989 Kernal
5,265,890 A * 11/1993 Balsells ..... F16F 3/12 277/467
5,311,938 A 5/1994 Hendrickson et al.
9,260,926 B2 * 2/2016 Givens ..... E21B 17/08
2006/0290066 A1 * 12/2006 Hiorth ..... E21B 33/1208 277/322

FOREIGN PATENT DOCUMENTS

GB 443082 A 2/1936

OTHER PUBLICATIONS

PCT International Search Report and Written Opinion dated Aug. 10, 2017, for International Patent Application No. PCT/US2017/034996.

* cited by examiner

*Primary Examiner* — Caroline N Butcher
(74) *Attorney, Agent, or Firm* — Patterson & Sheridan, LLP

(57) ABSTRACT

An anti-extrusion device used in a packer or a bridge plug is disclosed. The anti-extrusion device includes a garter spring and a support assembly having a ring shaped body disposed in an entire circumference of an inner volume of the garter spring. The ring shaped body expands with expansion of the garter spring while maintaining a continuous ring.

18 Claims, 15 Drawing Sheets

ANTI-EXTRUSION BARRIER FOR PACKING ELEMENT

BACKGROUND

Field

Embodiments of the present disclosure relate to anti-extrusion barriers for packing element.

Description of the Related Art

During hydrocarbon recovery, operators may deploy packers and bridge plugs downhole to isolate portions of a borehole for various operations. Typically, the packer or bridge plug has a deformable element used to form a seal against the surrounding borehole wall. When being deployed, the deformable element may need to pass through a restriction that is smaller than the diameter of the borehole where the element is to be set. Once deployed at the desired location, the deformable element can then be set by compression, inflation, or swelling depending on the type of element used. For example, a compression set element in a packer or plug having a sleeve that is compressed to increase the element's diameter to form a seal. Extrusion may occur when a portion of the compression set element flows into a gap between the seal bore and the packer or plug. If the extrusion is severe, the compression set element will no longer be able to maintain a seal with the seal bore.

Various anti-extrusion devices, such as garter springs, back up rings, or similar devices, have been used to reduce the extrusion of sealing material and maintain the seal with the seal bore. However, when the packer or plug works at an environment of high pressure and/or high temperature, existing anti-extrusion devices are not adequate resulting in a leaky seal.

Therefore, there is a need for a sealing element with improved anti-extrusion device.

SUMMARY

Embodiments of the present disclosure generally relate to an anti-extrusion device used in a packer or a bridge plug.

One embodiment of the present disclosure provides an anti-extrusion device comprising a supporting member having a ring shaped body, and a garter spring surrounding the ring shaped body, wherein an outer diameter of the ring shaped body varies with extension and retraction of the garter spring without forming a gap in an inner volume of the garter spring.

Another embodiment provides a packing element a tubular body, and an extrusion device disposed on an outer surface of the tubular body. The extrusion device includes a supporting member having a ring shaped body, and a garter spring surrounding the ring shaped body. An outer diameter of the ring shaped body varies with extension and retraction of the garter spring without forming a gap in an inner volume of the garter spring.

Another embodiment provides a packer comprising a mandrel, a packing element disposed on the mandrel, and a shoulder member adjacent the packing member. The packing element includes a tubular body disposed on an outer surface of the mandrel, and an extrusion device disposed on and outer surface of the tubular body. The extrusion device includes a supporting member having a ring shaped body, and a garter spring surrounding the ring shaped body, wherein an outer diameter of the ring shaped body varies with extension and retraction of the garter spring without forming a gap in an inner volume of the garter spring.

BRIEF DESCRIPTION OF THE DRAWINGS

So that the manner in which the above recited features of the present disclosure can be understood in detail, a more particular description of the various aspects, briefly summarized above, may be had by reference to embodiments, some of which are illustrated in the appended drawings. It is to be noted, however, that the appended drawings illustrate only typical embodiments of this disclosure and are therefore not to be considered limiting of its scope, for the disclosure may admit to other equally effective embodiments.

Figures 1A, 1B:
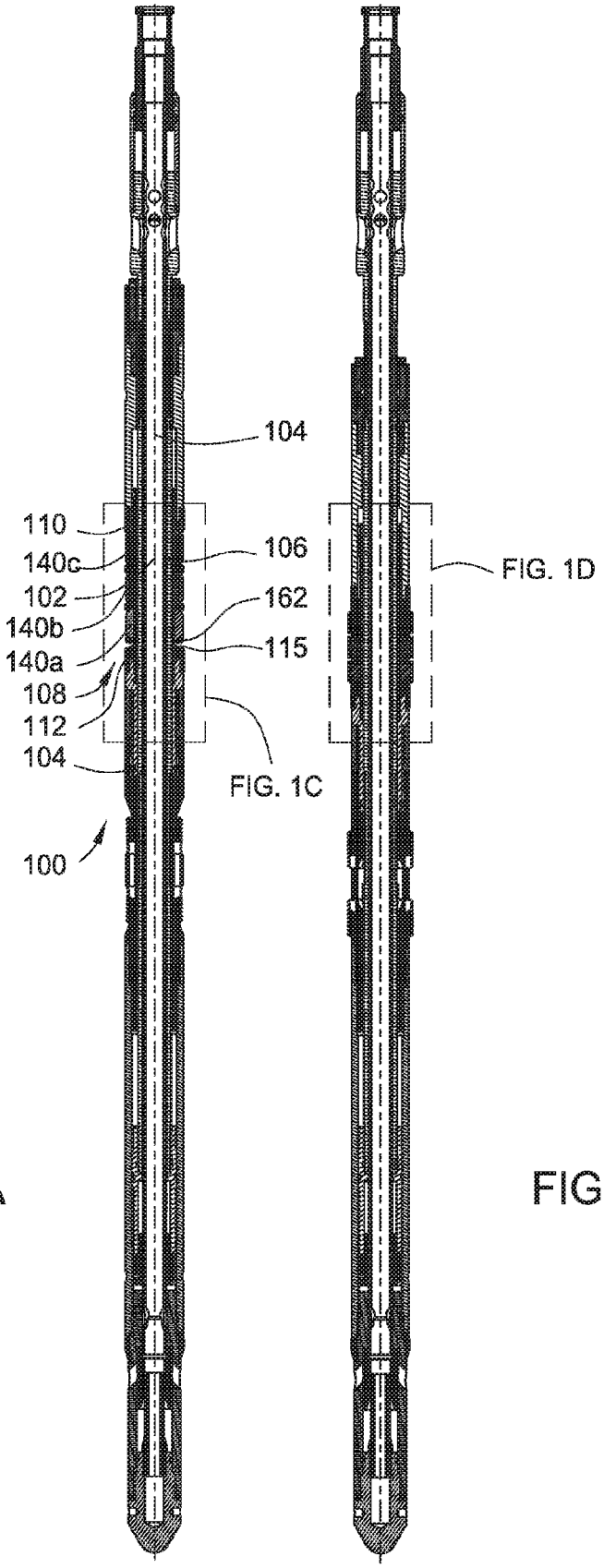
FIG. 1A is a schematic sectional view a packer according to one embodiment of the present disclosure in a run-in position.
FIG. 1B is a schematic sectional view of the packer of FIG. 1A in a sealed position.

To facilitate understanding, identical reference numerals have been used, where possible, to designate identical elements that are common to the figures. It is contemplated that elements disclosed in one embodiment may be beneficially utilized on other embodiments without specific recitation. The drawings referred to here should not be understood as being drawn to scale unless specifically noted. Also, the drawings are often simplified and details or components omitted for clarity of presentation and explanation. The drawings and discussion serve to explain principles discussed below, where like designations denote like elements.

DETAILED DESCRIPTION

In the following description, numerous specific details are set forth to provide a more thorough understanding of the present disclosure. However, it will be apparent to one of skill in the art that the present disclosure may be practiced without one or more of these specific details. In other instances, well-known features have not been described in order to avoid obscuring the present disclosure.

Embodiments of the present disclosure generally relate to an anti-extrusion device used in a packer or a bridge plug. The anti-extrusion device according to the present disclosure may include a garter spring and a solid support assembly substantially filled an inner volume of the garter spring. The support assembly may extend and retract with the garter spring while maintaining continuous support and/or barrier along the entire circumference of the garter spring. In one embodiment, the support assembly may include two C-rings having non-overlapping openings. In another embodiment, the support assembly may include a ring having a split portion.

FIG. 1A is a schematic sectional view a packer 100 according to one embodiment of the present disclosure. The packer 100 may include a mandrel 102 having a central bore 104. A packing element assembly 108 may be disposed on an outer surface 106 of the mandrel 102. The packing element assembly 108 may be disposed between two shoulder elements 110 and 112. The packing element assembly 108 may be disposed in a recess 115 formed between shoulders 114 and 116 of the shoulder elements 110 and 112. In one embodiment, at least one of the shoulders 114, 116 is tapered so that the recess 115 widens at the opening.

The packing element assembly 108 may include one or more packing elements. In the embodiment of FIG. 1A, the packing element assembly 108 includes three tubular seal bodies 140*a*, 140*b*, 140*c* arranged around the mandrel 102. Each of the seal body 140*a*, 140*b*, 140*c* may be a tubular body having an inner surface 148 and an outer surface 150. In one embodiment, dividers 146 may be disposed between the seal bodies 140*a*, 140*b*, 140*c*. The seal bodies 140*a*, 140*b*, 140*c* may deform to form a seal with between the outer surface 150 and an inner surface of a tubular. The dividers 146 may be rigid and configured to prevent the seal bodies 140*a*, 140*b*, 140*c* from buckling the seal bodies 140*a*, 140*b*, 140*c* deform.

The seal bodies 140*a*, 140*b*, 140*c* may be formed from materials that deforms under certain conditions, such as under compression, temperature change, or other triggers. In one embodiment, the seal body 140*a*, 140*b*, 140*c* may be made of materials that deforms under compression, for example elastomer, such as nitrile, plastic, such as PEEK or polyethylene. The dividers 146 may be formed from rigid material, such as metal.

The shoulder elements 110, 112 may move relative to each other to compress and set the packing element assembly 108 and/or to release the packing element assembly 108. For example, the shoulder element 110 may be connected to a sleeve radially movable along the mandrel 102. The shoulder element 110 may be moved towards the shoulder element 112, the length of the recess 115 reduces thus compressing the packing element assembly 108 so that the packing element assembly 108 protrudes over an outer diameter 118 of the shoulder elements 112. The outer diameter of the packing element 108 may contact an inner surface of a bore to form a seal. The shoulder element 110 may be moved away from the shoulder element 112 to allow the packing element 108 to recover and retrieve within the recess 115, therefore, allow the packer 100 to be retrieved from the bore.

In FIG. 1A, the packer 100 is in a run-in position. The packer 100 may be deployed to the target location in the run-in position. Once the packer 100 arrives at a target location, the shoulder elements 110, 112 may be moved toward each other and the packer 100 may be in a sealed position, as shown in FIG. 1B.

In one embodiment, the packing element assembly 108 may include one or more anti-extrusion devices. In the embodiment of FIG. 1A, anti-extrusion devices 142, 144 may be disposed on the outer surface 150 of the seal bodies 140*a*, 140*c* respectively. The anti-extrusion devices 142, 144 may be embedded in the seal bodies 140*a*, 140*c* on opposite ends of the outer surface 150. Each of the anti-extrusion devices 142, 144 may be a ring shaped member with a diameter 143. The diameter 143 is variable to accommodate the radial movement of the tubular seal bodies 140*a*, 140*c* between the run-in position and the sealed position. In one embodiment, each of the anti-extrusion devices 142, 144 may be a garter spring having a solid support assembly disposed therein.

Figure 1C:
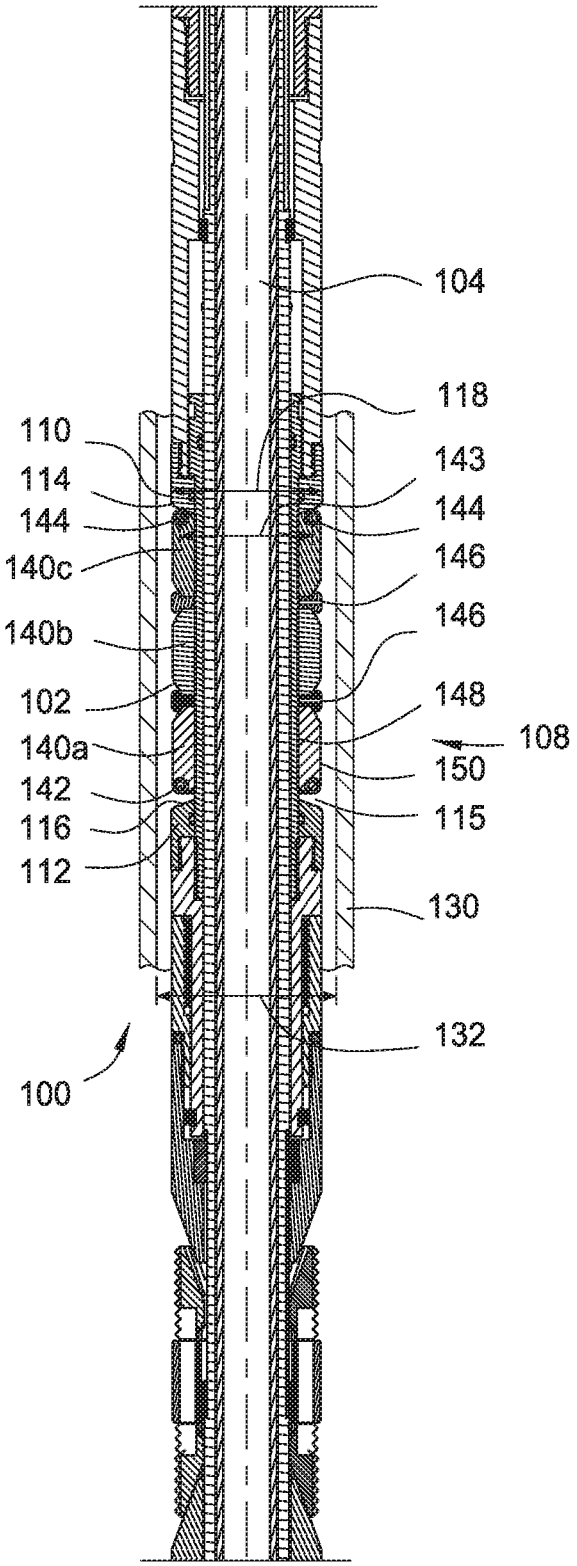
FIG. 1C is a schematic partial view of the packer of FIG. 1A in a run-in position.
Figure 1D:
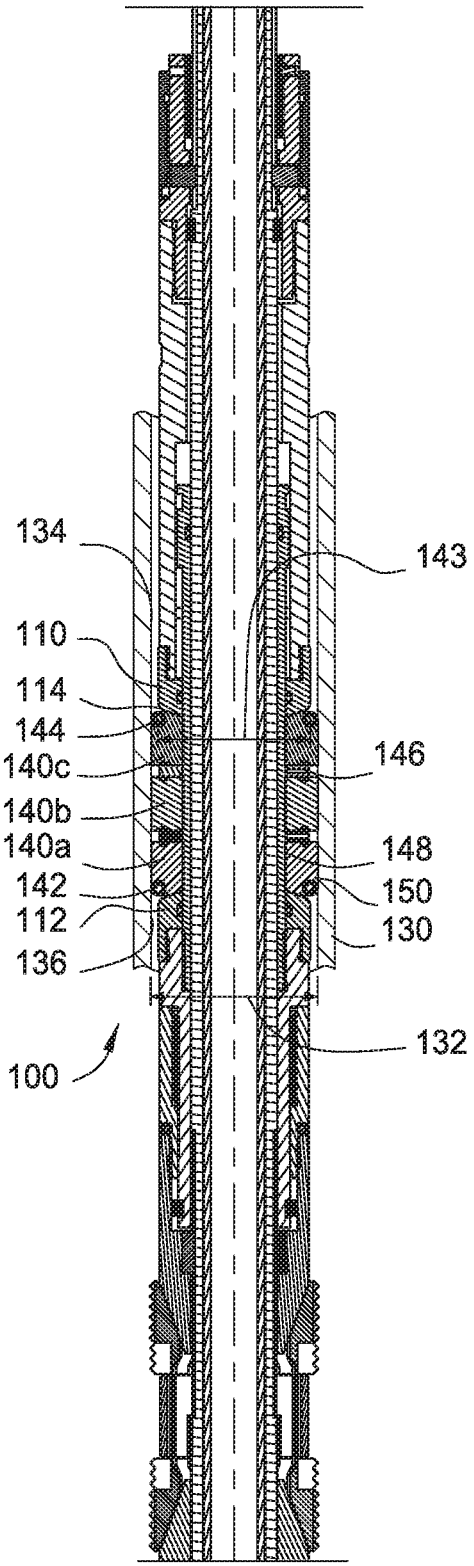
FIG. 1D is a schematic partial view of the packer of FIG. 1B in a sealed position.

FIG. 1C is a schematic partial view of the packer 100 in the run-in position. FIG. 1D is a schematic partial view of the packer 100 in the sealed position. In the run-in position shown in FIG. 1C, the outer surface 150 of the seal bodies 140*a*, 140*b*, 140*c* is within the outer diameter 118 of the shoulder elements 110, 112. The packer 100 may be run-in a bore hole 130 having an inner diameter 132 larger than the outer diameter 118. The packer 100 may be attached to a tubular string and run-in the bore hole 130 downhole.

FIG. 1D is a schematic partial view of the packer 100 in the sealed position. When the packer 100 is run-in at a target position, the shoulder element 110 may be activated to compress the packing element assembly 108 axially. Under axially compression, the tubular seal bodies 140*a*, 140*b*, 140*c* of the packing element assembly 108 expands radially and the outer surface 150 moves radially outward to contact and form a seal with the inner surface 132 of the bore 130. The tapered shoulders 114, 116 guide the tubular bodies 140*a*, 140*c* radially outward during compression.

At the sealed position, the anti-extrusion devices 142, 144 move out of the recess 150. As shown in FIG. 1D, the anti-extrusion devices 142, 144 are positioned on exterior ends of the tubular bodies 140*a*, 140*c* to prevent the tubular bodies 140*a*, 140*c* from entering gaps 134, 136 between the packer 100 and the bore 130.

As shown in FIGS. 1C and 1D, the anti-extrusion devices 142, 144 expand with the outer surface 150 of the tubular bodies 140*a*, 140*c* as the packer 100 moves from the run-in position to the sealed position. The diameter 143 of the anti-extrusion devices 142, 144 increases during the expansion. According to embodiments of the present disclosure, the anti-extrusion devices 142, 144 include a support assembly which maintains the shape of a closed ring during expansion, thus prevent extrusions along the entire circumference of the tubular bodies 140*a*, 140*c*.

Figure 2A:
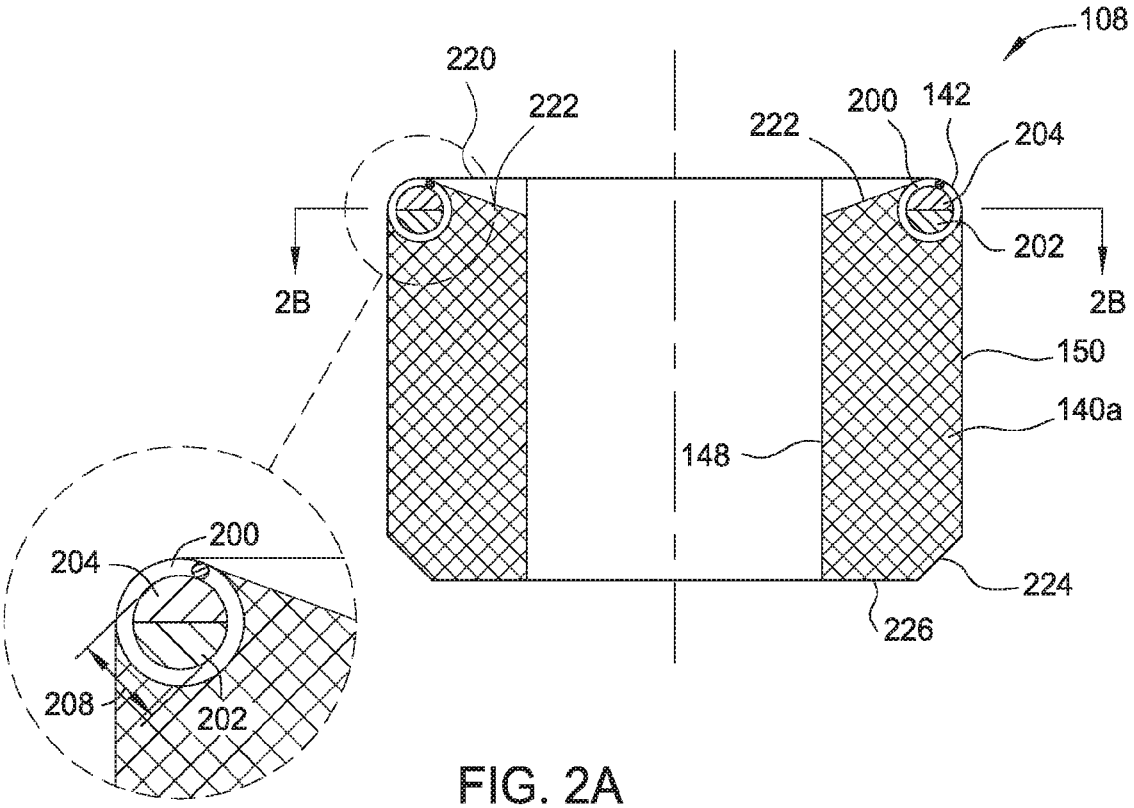
FIG. 2A is a schematic sectional side view of a packing element according to one embodiment of the present disclosure.
Figure 2B:
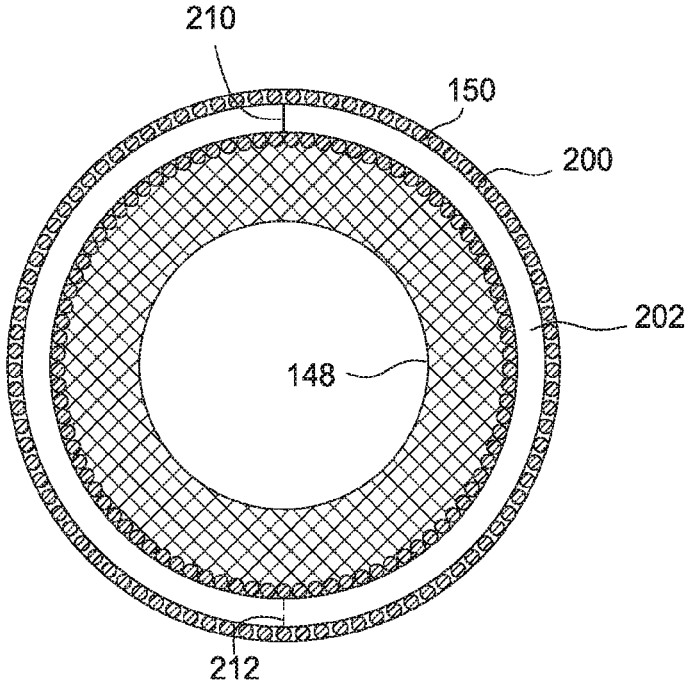
FIG. 2B is a schematic sectional top view of the packing element of FIG. 2A.
Figure 2C:
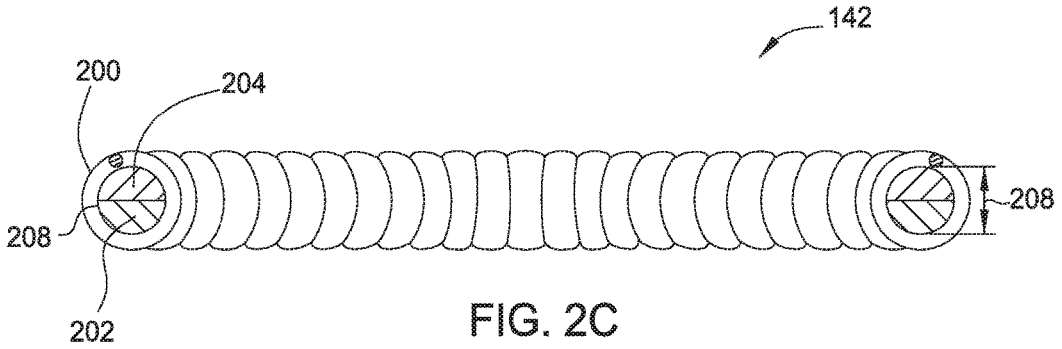
FIG. 2C is a schematic sectional view of an anti-extrusion device according to one embodiment of the present disclosure.

One embodiment of the packing element 108 is shown in detail in FIGS. 2A-2B. FIG. 2A is a schematic sectional side view of the packing element 108 according to one embodiment of the present disclosure. FIG. 2B is a schematic sectional top view of the packing element 108. In one embodiment, the seal body 140*a* may have a sloped upper surface 222 at an upper end 220. A chamfer 224 may be formed on a lower end 226 of the seal body 140*a*. The anti-extrusion device 142 is embedded in the body 140*a* at the upper end 220. The anti-extrusion device 142 includes a garter spring 200 and support rings 202, 204 disposed in the inner volume of the garter spring 200. Particularly, the garter spring 200 is a coiled spring connected at opposite ends to form a spring of a circular shape. FIG. 2C is a schematic sectional view of the anti-extrusion device 142. The garter spring 200 may be embedded in the body 140*a* and will expand or retract with the body 140*a* as the diameter of the outer surface 150 increases or decreases.

Each of the support rings 202, 204 may be a complete ring having one or more opening 210, 212. The support rings 202, 204 are stacked together to form a solid ring to fill the inner volume of the garter spring 200. The openings 210, 212 of the support rings 202, 204 are positioned in different locations and do not overlap. In one embodiment, the openings 210, 212 are positioned at 180 degrees from each other. As shown in FIG. 2A, each of the support rings 202, 204 may have a semi-circular sectional area to form a solid ring having a circular sectional area. In one embodiment, the combined sectional area of the support rings 202, 204 form a circular sectional area having a diameter 208. The diameter 208 is substantially similar to the diameter of the inner volume of the garter spring 200. Even though two supporting rings 202, 204 are shown, more support rings 202, 204 may be used.

Figure 3A:
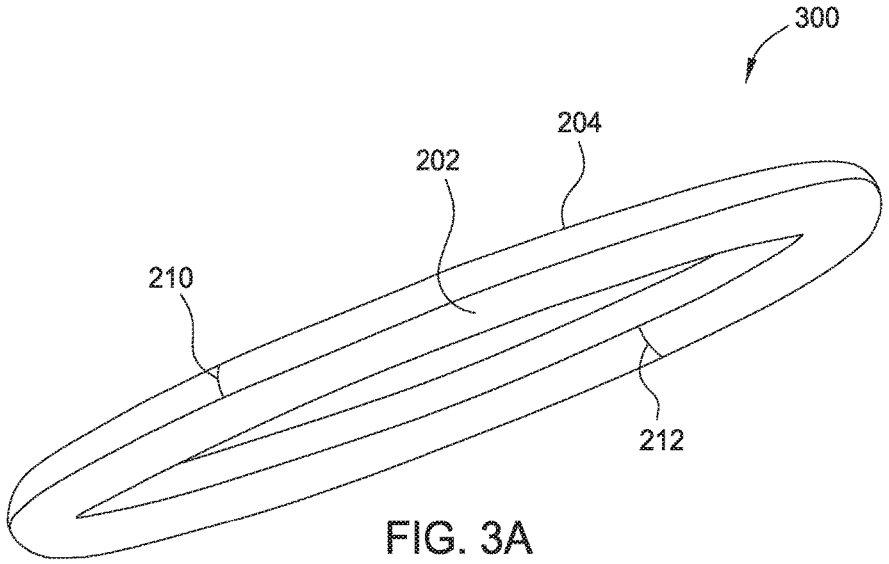
FIG. 3A is a schematic perspective view of a support assembly according to one embodiment of the present disclosure.
Figure 3B:
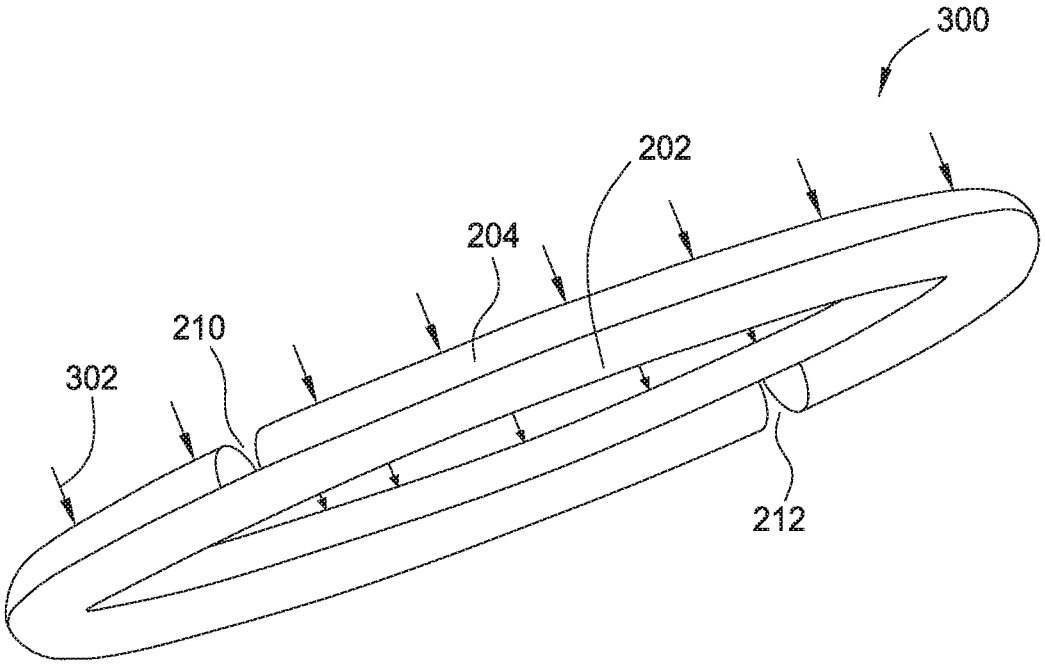
FIG. 3B is a schematic perspective view of the support assembly of FIG. 3A in a stretched position.

FIG. 3A is a schematic perspective view of a support assembly 300 according to one embodiment of the present disclosure. The support assembly 300 may be disposed in a garter spring, such as the garter spring 200 in the anti-extrusion device 142, 144, to provide support along the entire circumference of the garter spring and to reduce extrusions between coils of the garter spring when the garter spring stretches. FIG. 3B is a schematic perspective view of the support assembly 300 in a stretched position.

The support assembly 300 includes the support rings 202, 204. In the embodiment shown in FIGS. 3A, 3B, the support ring 202 may be a C-ring having one opening 210. The opening 210 is closed when the packing element 108 is not compressed, such as in the run-in position, as shown in FIG. 3A. When the support ring 202 is being stretched, for example when the garter spring 200 expands with the outer surface 150 of the body 140*a*, the opening 210 opens up to allow the garter spring 200 to stretch, as shown in FIG. 3B. Similarly, the support ring 204 may be a C-ring having an opening 212. The opening 212 is closed when the packing element 108 is not compressed, such as in the run-in position, shown in FIG. 3A. When the support ring 204 is stretched, for example when the garter spring 200 expands with the outer surface 150 of the body 140*a*, the opening 212 opens up to allow the garter spring 200 to stretch. The opening 212 is positioned at a different location from the opening 210 so that the garter spring 200 retains support along the entire circumference after expansion. As shown in FIG. 3B, when the garter spring 200 and the body 140*a* of the packing element 108 are exposed to an axial force 302, which may be caused by a pressure differential between the gaps 134, 136, the support assembly 300 provides support and barrier along the entire circumference, therefore preventing the garter spring 200 from deformation and the body 140*a* from extrusion through the inner volume of the garter spring 200.

In one embodiment, the deformation of the support rings 202, 204 at the stretched position is within the yield strength of the material of the support rings 202, 204 so that the support rings 202, 204 can fully recover from the stretched position to the closed position. Therefore, when the garter spring 200 returns to the original non-extended position, the support rings 202, 204 also return to the closed position allowing the packer with the garter spring 200 to be retrieved. In one embodiment, the outer diameter of the support assembly 300 may increase about 5% from the closed position in FIG. 3A to the open position in FIG. 3B. For example, the outer diameter of the support assembly 300 may be about 4.75 inch at the closed position of FIG. 3A and about 5 inch at the stretched position in FIG. 3B.

The support rings 202, 204 may be formed from a metal, an elastomer, such as nitrile, a plastic, such as PEEK or polyethylene, and a thermoplastic depending on the operation condition. The material of the support rings 202, 204 may be selected according to function and properties of the packer, for example, retrievable or permanent.

When the support rings 202, 204 are used in a retrievable packer, the material of the support rings 202, 204 may be selected so that the deformation of the support rings 202, 204 from the run-in position to the sealed position is within the elastic deformation of the material. In one embodiment, the support rings 202, 204 may be formed from a metal of yield strength of above 175 k psi to support seal bodies in a retrievable packer. In one embodiment, the support rings 202, 204 may be formed from a metal having yield strength between about 175 k psi to about 225 k psi to support seal bodies in a retrievable packer.

When the support rings 202, 204 are used in a permanent packer, the material of the support rings 202, 204 may be selected so that the deformation of the support rings 202, 204 from the run-in position to the sealed position may be elastic deformation or plastic deformation. The support rings 202, 204 may be formed from any material that allows the deformation from run-in to sealed position at operational temperatures.

Figure 4B:
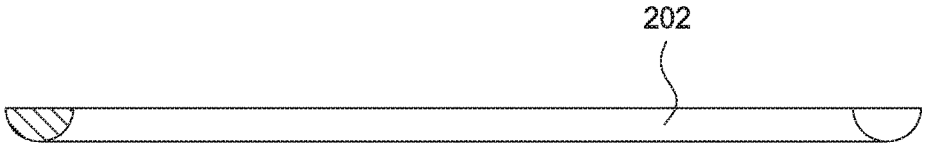
FIG. 4B is a schematic sectional view of the support ring of FIG. 4A.
Figure 4A:
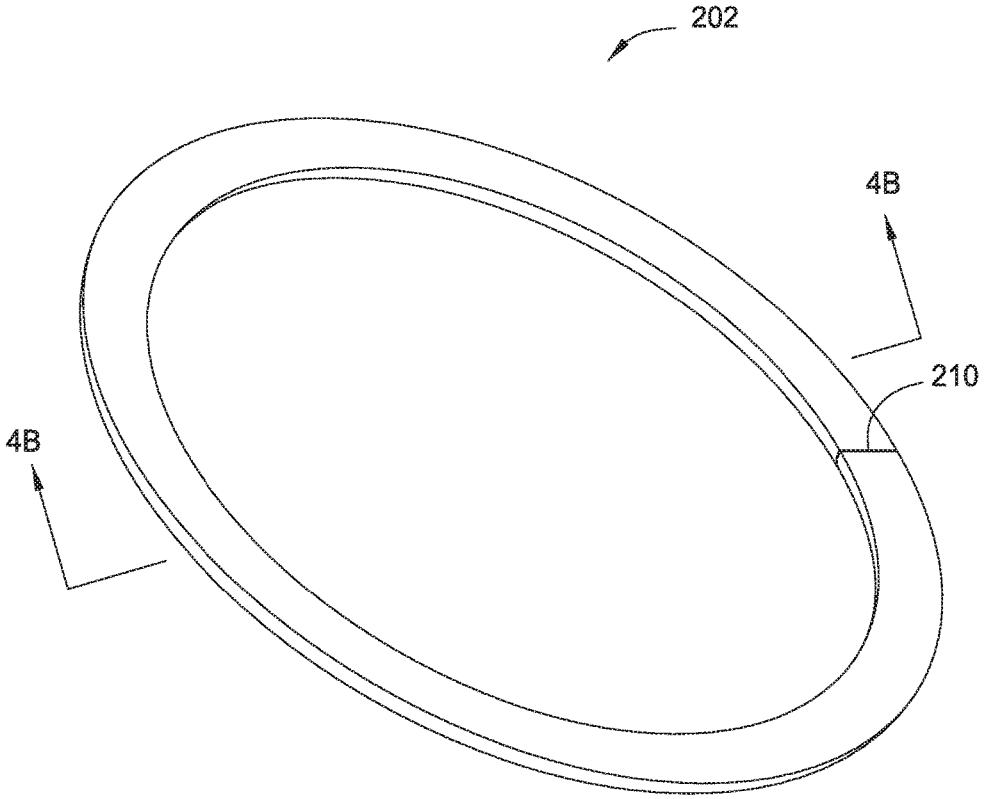
FIG. 4A is a schematic perspective view of a support ring according to one embodiment of the present disclosure.

FIG. 4A is a schematic perspective view of the support ring 202 according to one embodiment of the present disclosure. FIG. 4B is a schematic sectional view of the support ring 202. The support ring 202 has a semi-circular sectional area. Two support rings 202 may be stacked together to form the support assembly 300.

Figure 5A:
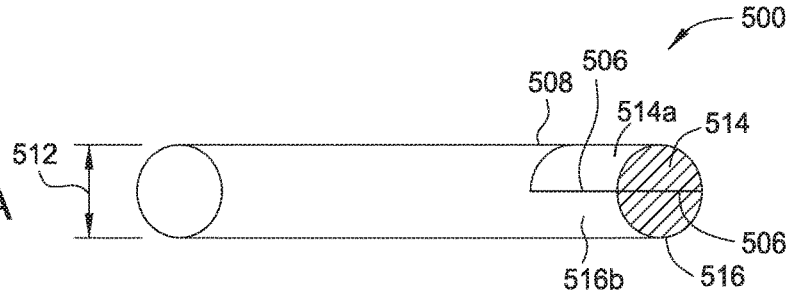
FIG. 5A is a schematic sectional view of a support assembly according to one embodiment of the present disclosure.
Figure 5B:
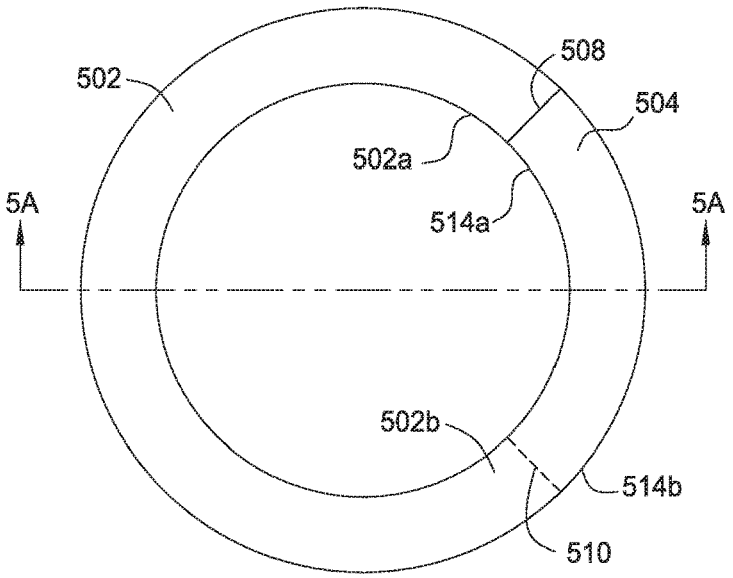
FIG. 5B is a schematic top view of the support assembly of FIG. 5A in a closed position.
Figure 5C:
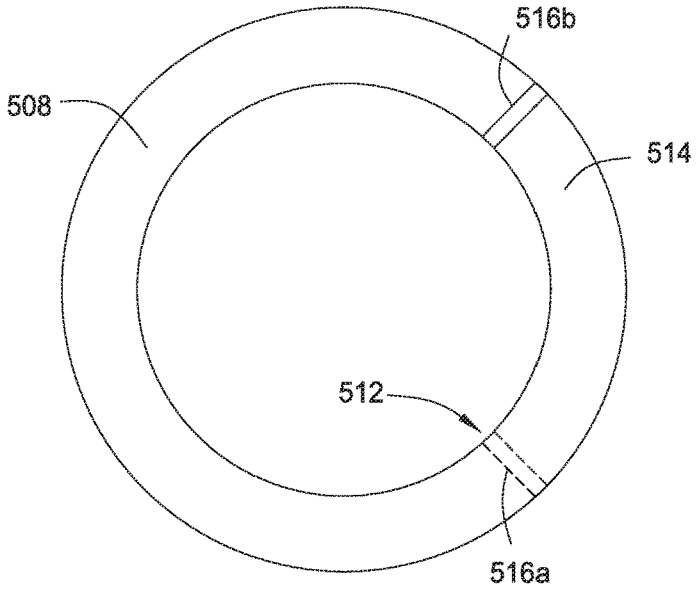
FIG. 5C is a schematic top view of the support assembly of FIG. 5A in a stretched position.

FIG. 5A is a schematic sectional view of a support assembly 500 according to one embodiment of the present disclosure. The support assembly 500 may be used in place of the support assembly 300 to support a garter spring in an anti-extrusion device, such as the anti-extrusion device 142, 144. FIG. 5B is a schematic top view of the support assembly 500 in a closed position. FIG. 5C is a schematic top view of the support assembly 500 in a stretched position.

The support assembly 500 may have a ring shaped body formed by a joined section 502 and a split section 504. The ring shaped body may have a circular cross sectional area. The joined section 502 has a first end 502*a* and a second end 502*b*. A diameter 512 of the cross-sectional area may be substantially similar to the diameter of the inner volume of a garter spring to be supported.

The split section 504 may include an upper portion 514 and a lower portion 516. In one embodiment, each of the upper portion 514 and lower portion 516 may have a semi-circular cross sectional area as if the section 504 is split open along a plane 506. The upper portion 514 may include a free end 514*a* and a fixed end 514*b*. The fixed end 514*a* of the upper portion 514 is connected to the joined section 502 at the second end 502*b*. An opening 508 is formed between the first end 502*a* of the joined section 502 and the free end 514*a* of the upper portion 514. Similarly, a fixed end 516*a* of the lower portion 516 may be connected to the joined section 502 at the first end 502*a*. An opening 510 is formed between a free end 516*b* of the lower portion 516 and the second end 502*b* of the joined section 502. The openings 508 and 510 are located at different positions. The split section 504 allows the support assembly 500 to expand.

As shown in FIG. 5C, the support assembly 500 is stretched, for example when the garter spring 200 expands with the outer surface 150 of the body 140, the upper portion 514 and lower portion 516 moves relative to each other expanding the openings 508, 510 and the diameter of the support assembly 500. The non-overlapping openings 508, 510 provide continuous support along the entire circumference of the garter spring surrounding the support assembly 500 as the garter spring extends or retracts. When the garter spring surrounding the support assembly 500 returns to the original non-expanded position, the support assembly 500 may also return to the closed position, as shown in FIG. 5A.

The support assembly 500 may be formed from a metal, an elastomer, such as nitrile, a plastic, such as PEEK or polyethylene, and a thermoplastic depending on the operation condition. The material of the support assembly 500 may be selected according to function and properties of the packer, for example, retrievable or permanent.

When the support assembly 500 used in a retrievable packer, the material of the support assembly 500 may be selected so that the deformation of the support assembly 500 from the run-in position to the sealed position is within the elastic deformation of the material. The support assembly 500 may be formed from a material that maintains elasticity when the support assembly 500 moves between the run-in position and the sealed position under the operation temperature. In one embodiment, the support assembly 500 may be formed from a metal of yield strength of above 175 k psi to support seal bodies in a retrievable packer. In one embodiment, the support assembly 500 may be formed from a metal having yield strength between about 175 k psi to about 225 k psi to support seal bodies in a retrievable packer.

When the support assembly 500 is used in a permanent packer, the material of the support assembly 500 may be selected so that the deformation of the support assembly 500 from the run-in position to the sealed position may be elastic deformation or plastic deformation. The support assembly 500 may be formed from any material that allows the deformation from run-in to sealed position at operational temperatures.

Figure 6A:
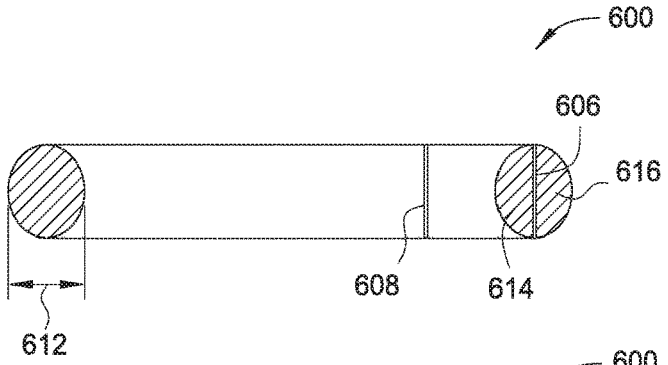
FIG. 6A is a schematic sectional view of a support assembly according to one embodiment of the present disclosure.
Figure 6B:
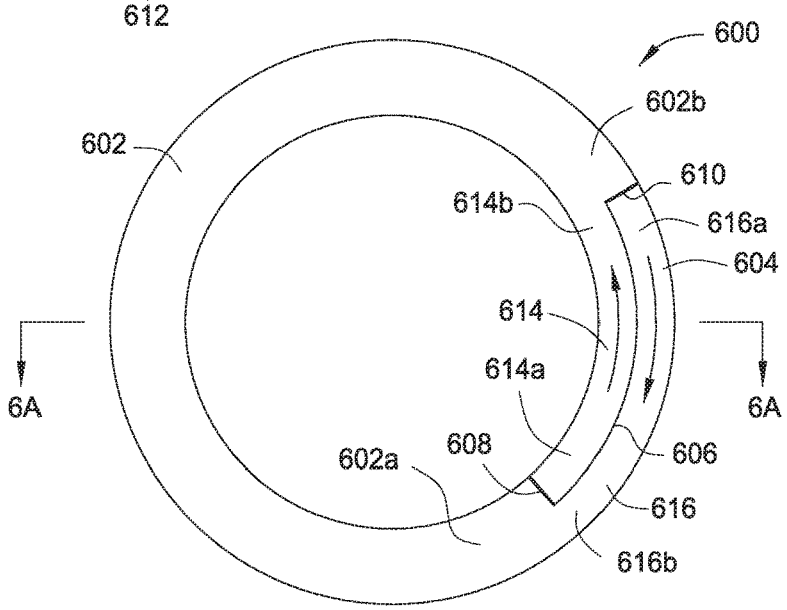
FIG. 6B is a schematic top view of the support assembly of FIG. 6A in a closed position.
Figure 6C:
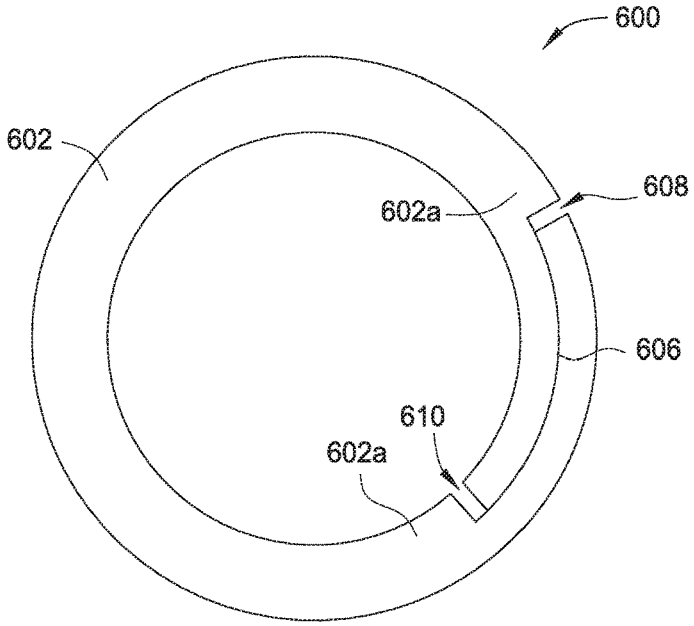
FIG. 6C is a schematic top view of the support assembly of FIG. 6A in a stretched position.

FIG. 6A is a schematic sectional view of a support assembly 600 according to one embodiment of the present disclosure. The support assembly 600 may be used in place of the support assembly 300 to support a garter spring in an anti-extrusion device, such as the anti-extrusion device 142, 144. FIG. 6B is a schematic top view of the support assembly 600 in a closed position. FIG. 6C is a schematic top view of the support assembly 600 in a stretched position.

The support assembly 600 may include a ring shaped body formed by a joined section 602 and a split section. The ring shaped body may have a circular cross sectional area. A diameter 612 of the cross-sectional area may be substantially similar to the diameter of the inner volume of a garter spring to be supported. The joined section 602 may include a first end 602*a* and a second end 602*b*. The split section 604 may include an inner portion 614 and an outer portion 616. In one embodiment, each of the inner portion 614 and outer portion 616 may have a semi-circular cross sectional area as if the section 604 is split open along a cylindrical surface 606. The inner portion 614 may include a free end 614*a* and a fixed end 614*b*. The fixed end 614*b* of the inner portion 614 is connected to the second end 602*b* of the joined section 602. An opening 608 is formed between the first end 602*a* of the joined section 602 and the free end 614*a* of the inner portion 614. Similarly, a fixed end 616*a* of the outer portion 616 may be connected to the first end 602*a* of the joined section 602. An opening 610 is formed between a free end 616*b* of the outer portion 616 and the second end 602*b* of the joined section 602. The openings 608 and 610 are located at different positions. The split section 604 allows the support assembly 600 to expand.

As shown in FIG. 6C, the support assembly 600 is stretched, for example when the garter spring 200 expands with the outer surface 150 of the body 140*a*, the inner portion 614 and outer portion 616 moves relative to each other expanding the openings 608, 610 and the diameter of the support assembly 600. The non-overlapping openings 608, 610 provide continuous support along the entire circumference of the garter spring surrounding the support assembly 600 as the garter spring extends or retracts. When the garter spring surrounding the support assembly 600 returns to the original non-expanded position, the support assembly 600 may also return to the closed position, as shown in FIG. 6A.

The support assembly 600 may be formed from a metal, an elastomer, such as nitrile, a plastic, such as PEEK or polyethylene, and a thermoplastic depending on the operation condition. The material of the support assembly 600 may be selected according to function and properties of the packer, for example, retrievable or permanent.

When the support assembly 600 used in a retrievable packer, the material of the support assembly 600 may be selected so that the deformation of the support assembly 600 from the run-in position to the sealed position is within the elastic deformation of the material. In one embodiment, the support assembly 500 may be formed from a metal of yield strength of above 175 k psi to support seal bodies in a retrievable packer. In one embodiment, the support assembly 500 may be formed from a metal having yield strength between about 175 k psi to about 225 k psi to support seal bodies in a retrievable packer.

When the support assembly 600 is used in a permanent packer, the material of the support assembly 600 may be selected so that the deformation of the support assembly 600 from the run-in position to the sealed position may be elastic formation or plastic deformation. The support assembly 600 may be formed from any material that allows the deformation from run-in to sealed position at operational temperatures.

Figure 7A:
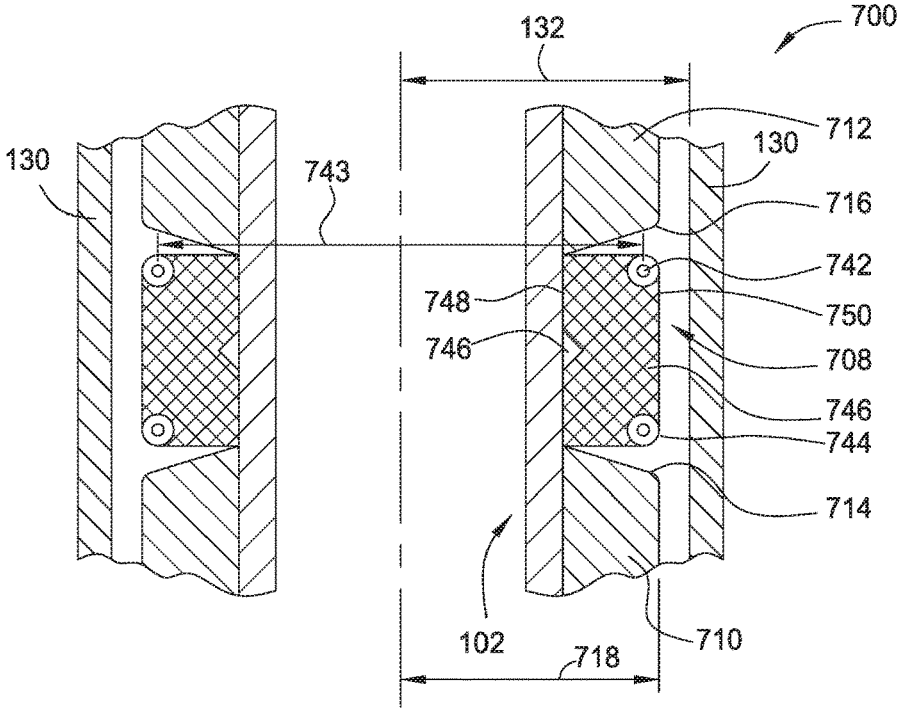
FIG. 7A is a schematic partial view of a packer according to one embodiment of the present disclosure in a run-in position.
Figure 7B:
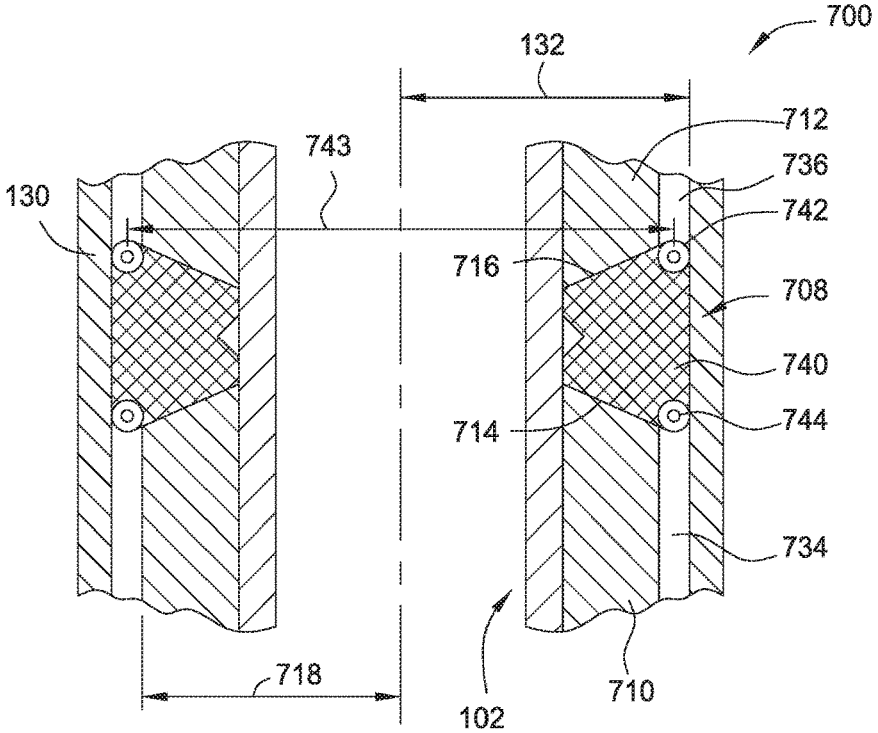
FIG. 7B is a schematic partial view of the packer of FIG. 7A in a sealed position.

Anti-extrusion devices according to embodiment of the present disclosure may be used in various packing elements. One or more anti-extrusion devices may be used in a single packing element. FIG. 7A is a schematic partial view of a packer 700 according to one embodiment of the present disclosure. The packer 700 has two anti-extrusion devices in a single packing element. FIG. 7A shows the packer 700 in a run-in position. FIG. 7B shows the packer 700 in a sealed position.

The packer 700 includes a packing element 708 including a seal body 740. The seal body 740 may be a tubular body having an inner surface 748 and an outer surface 750. A groove 746 may be formed in the inner surface 748 to prevent the body 740 from buckling. The seal body 740 may be made of material that deforms under compression, for example elastomer, such as nitrile, plastic, such as PEEK or polyethylene.

Anti-extrusion devices 742, 744 may be disposed on the outer surface 750 of the seal body 740. The anti-extrusion devices 742, 744 may be embedded in the body 740 on opposite ends of the outer surface 750. Each of the anti-extrusion devices 742, 744 may be a ring shaped member with a diameter 743. The diameter 742 is variable to accommodate the radial movement of the tubular body 740 between the run-in position and the sealed position. In one embodiment, each of the anti-extrusion devices 740, 742 may be a garter spring having a solid support assembly disposed therein.

In the run-in position shown in FIG. 7A, the outer surface 750 of the body 740 is within an outer diameter 718 of shoulder elements 710, 712. The packer 700 may be run-in the bore hole 130. The inner diameter 132 of the bore hole 130 may be larger than the outer diameter 118. The packer 700 may be attached to a tubular string and run-in the bore hole 130 downhole.

When the packer 700 is run-in at a target position, the shoulder element 110 may be activated to compress the packing element 708 axially. Under axially compression, the seal body 740 of the packing element 708 expands radially and the outer surface 750 moves radially outward to contact and form a seal with the inner surface 132 of the bore 130. The tapered shoulders 714, 716 guide the seal body 740 radially outward during compression.

At the sealed position, the anti-extrusion devices 742, 744 move out of the recess 150. The anti-extrusion devices 742, 744 are positioned on opposite ends of the seal body 740 to prevent the seal body 740 from entering gaps 734, 736 between the packer 700 and the bore 130.

The anti-extrusion devices 742, 744 expand with the outer surface 750 of the seal body 740 as the packer 700 moves from the run-in position to the sealed position. The diameter 743 of the anti-extrusion devices 742, 744 increases during the expansion. The anti-extrusion devices 742, 744 may be similar to the anti-extrusion device 142 described above.

Figure 8:
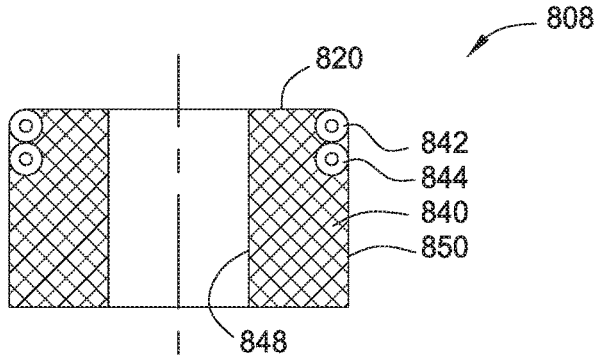
FIG. 8 is a schematic sectional view of a packing element according to one embodiment of the present disclosure.

FIG. 8 is a schematic sectional view of a packing element 808 according to one embodiment of the present disclosure. The packing element 808 includes a tubular seal body 840 having two anti-extrusion devices 842, 844 disposed near an upper end 820. The tubular seal body 840 may have an inner surface 848 and an outer surface 850. The anti-extrusion devices 842, 844 are disposed on the outer surface 850. In one embodiment, the seal body 840 may be used in place of the seal body 140*a* for the packer 100. The anti-extrusion devices 842, 844 may be similar to the anti-extrusion device 142 described above.

Figure 9A:
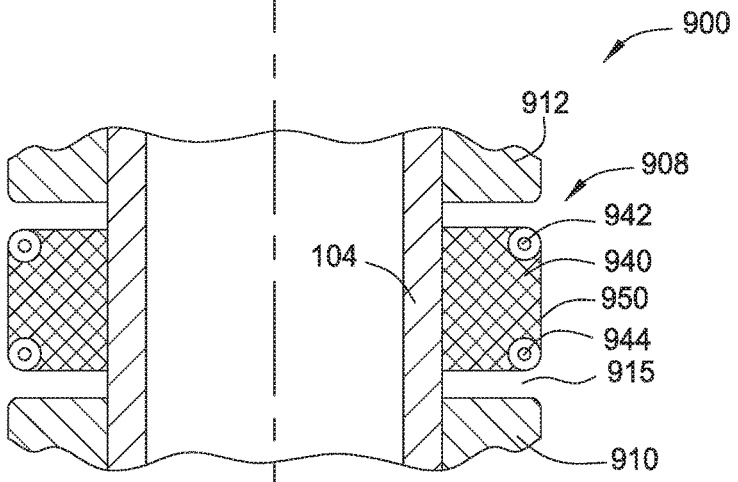
FIG. 9A is a schematic partial view of a packer according to one embodiment of the present disclosure in a run-in position.
Figure 9B:
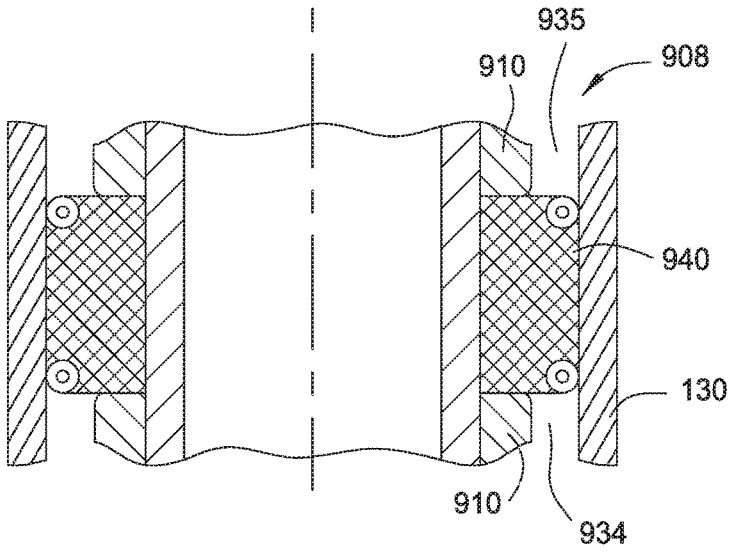
FIG. 9B is a schematic partial view of the packer of FIG. 9A in a sealed position.

FIG. 9A is a schematic partial view of a packer 900 according to one embodiment of the present disclosure in a run-in position. FIG. 9B is a schematic partial view of the packer 900 in a sealed position. The packer 900 includes a packing element 908 including a seal body 940. The seal body 940 may be a tubular body disposed in a recess 915 between shoulders 912 and 910. The seal body 940 may be made of material that swells or expand under a triggering condition, such as exposure to a triggering fluid, for example hydrocarbon fluids or water, a predetermined pressure, or a predetermined temperature. The seal body 940 may expand out of the recess 915 to form a seal with an inner surface of a bore hole.

In one embodiment, the seal body 940 may be formed from a swellable elastomeric material configured to increase in volume on exposure to a triggering fluid. In one embodiment, the seal body 940 may be formed from an ethylene propylene diene monomer (EPDM) rubber selected to swell in hydrocarbon fluids. Alternatively, the seal body 940 may be formed from a material configured to swell in both hydrocarbon fluids and aqueous fluid.

Anti-extrusion devices 942, 944 may be disposed on opposite ends of the seal body 940. The anti-extrusion devices 942, 944 may be embedded in or pre-molded in the body 940 near an outer surface 950 of the seal body 940. The anti-extrusion devices 942, 944 may prevent the seal body 940 from swelling into gaps 934, 935, thus, providing improved control to the swelling of the seal body 940. The anti-extrusion devices 942, 944 may be similar to the anti-extrusion device 142 described above.

Figure 10B:
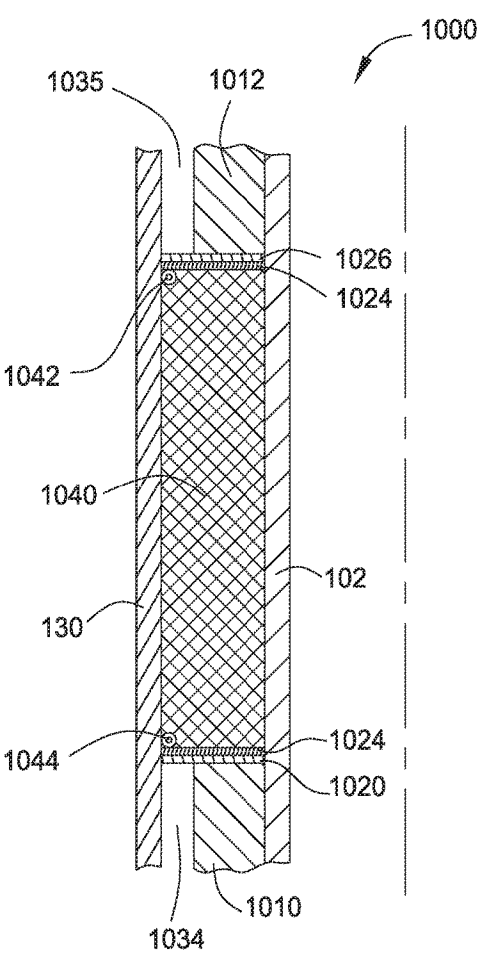
FIG. 10B is a schematic partial view of the packer of FIG. 10A in a sealed position.
Figure 10A:
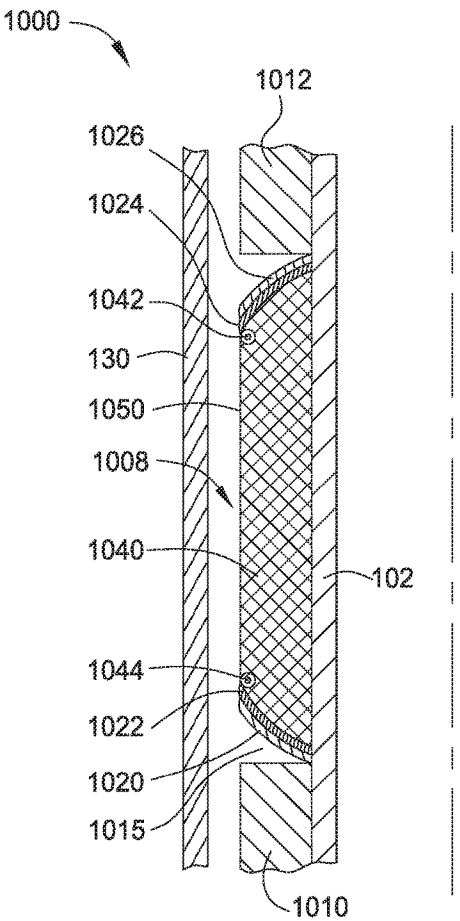
FIG. 10A is a schematic partial view of a packer according to one embodiment of the present disclosure in a run-in position.

FIG. 10A is a schematic partial view of a packer 1000 according to one embodiment of the present disclosure in a run-in position. FIG. 10B is a schematic partial view of the packer 1000 in a sealed position. The packer 1000 includes a packing element 1008 including a seal body 1040. The seal body 1040 may be a tubular body disposed in a recess 1015 between shoulders 1012 and 1010. The seal body 1040 may be made of material configured to increase in volume under a triggering condition, such as exposure to a triggering fluid, for example hydrocarbon fluids or water, a predetermined pressure, or a predetermined temperature. The seal body 1040 may expand out of the recess 1015 to form a seal with an inner surface of a bore hole.

A pair of support rings 1020, 1022 and 1024, 1026 may be disposed on each end of the seal body 1040. Each pair of support rings 1020, 1022 and 1024, 1026 may be in a conical or cup shape in the run-in position to retain the seal body 1040 between the pairs of the support rings 1022, 1022 and

1024, 1026. The support ring 1020, 1022, 1024, 1026 may include circumferentially spaced slots extending from an outer edge to a pre-determined lengths to allow the support ring 1020, 1022, 1024, 1026 to open when the seal body 1040 expands. The slots in each pair of support rings 1020, 1022 and 1024, 1026 may be arranged in a staggered manner to prevent leaking when the slots open.

In one embodiment, the seal body 1040 may be formed from a swellable elastomeric material configured to increase in volume on exposure to a triggering fluid. In one embodiment, the seal body 1040 may be formed from an ethylene propylene diene monomer (EPDM) rubber selected to swell in hydrocarbon fluids. Alternatively, the seal body 1040 may be formed from a material configured to swell in both hydrocarbon fluids and aqueous fluid.

Anti-extrusion devices 1042, 1044 may be disposed on opposite ends of the seal body 1040. The anti-extrusion devices 1042, 1044 may be embedded in or pre-molded in the body 1040 near an outer surface 1050 of the seal body 1040. The anti-extrusion devices 1042, 1044 may prevent the seal body 1040 from swelling into gaps 1034, 1035, thus, providing improved control to the swelling of the seal body 1040. The anti-extrusion devices 1042, 1044 may be similar to the anti-extrusion device 142 described above.

Figure 11B:
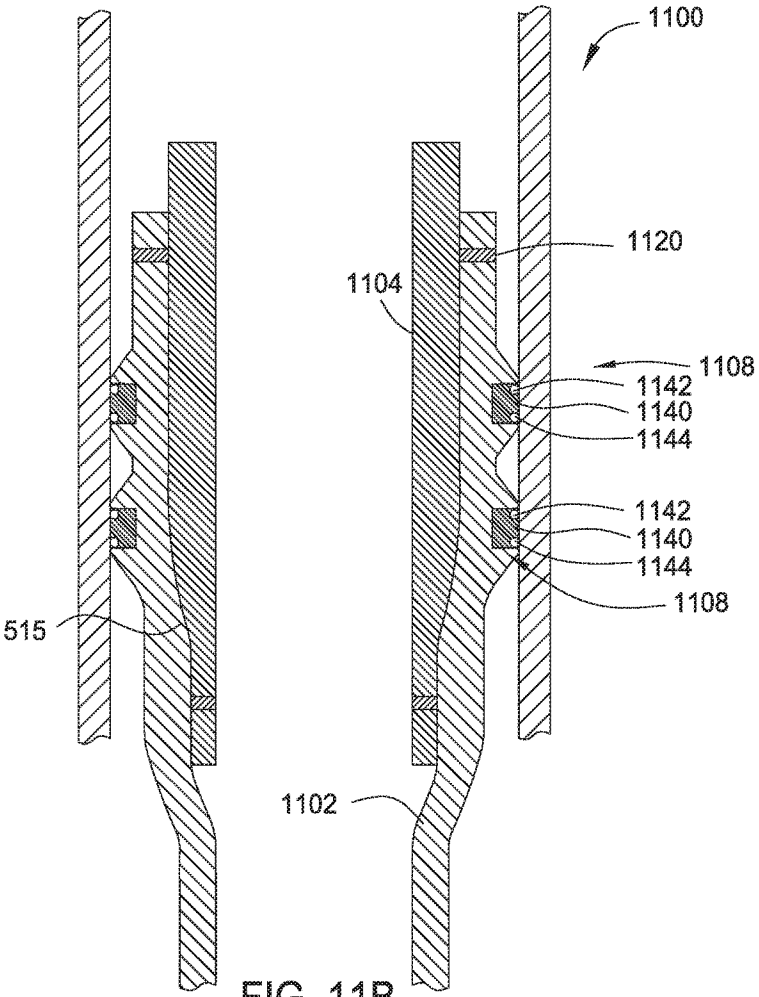
FIG. 11B is a schematic partial view of the packer of FIG. 11A in a sealed position.
Figure 11A:
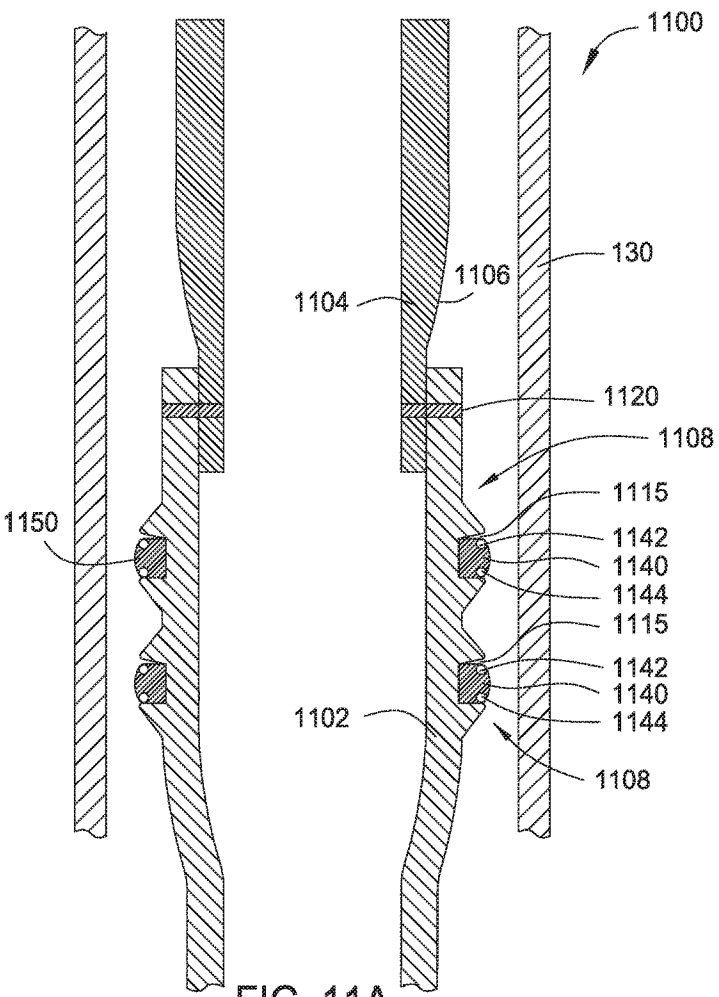
FIG. 11A is a schematic partial view of a packer according to one embodiment of the present disclosure in a run-in position.

FIG. 11A is a schematic partial view of a packer 1100 according to one embodiment of the present disclosure in a run-in position. FIG. 11B is a schematic partial view of the packer 1100 in a sealed position. The packer 1100 is an expandable packer. The packer 1100 may include one or more packing elements 1108 disposed on a mandrel 1102. The mandrel 1102 may be a casing hanger. An expander sleeve 1104 may be releasably attached to the mandrel 1102. The expander sleeve 1104 includes a tapered outer surface 1106 configured to expand the inner diameter of the mandrel 1102. In one embodiment, the expander sleeve 1104 may be releasably attached to the mandrel 1102 by a shear pin 1120.

The one or more packing elements 1108 may be circumferentially spaced around the mandrel 1102 to create a seal between the mandrel 1102 and the bore hole 130. Each packing element 1108 may include a seal body 1140 disposed in a gland 1115. A bonding material, such as glue (or other attachment means), may be used on selective sides of the gland 1115 to attach the seal body 1140 in the gland 1115. The seal body 1140 may be made of material that deforms under compression, for example elastomer, such as nitrile, plastic, such as PEEK or polyethylene.

One or both sides of the gland 1115 may be sloped to create a volume gap between the seal body 1140 and the gland 1115 at the run-in position. The volume gap may minimize distortion of the seal body 1140 upon expansion of the mandrel 1120. The volume gap may be created in any configuration.

Anti-extrusion devices 1142, 1144 may be disposed on opposite ends of the seal body 1140. The anti-extrusion devices 1142, 1144 may be embedded in or pre-molded in the body 1140 near an outer surface 1150 of the seal body 1140. The anti-extrusion devices 1142, 1144 may limit the extrusion of the seal body 1140 during and after expansion of the packer 1100. The anti-extrusion devices 1142, 1144 may be similar to the anti-extrusion device 142 described above.

To set the packer 1100, an axial force may be applied to between the mandrel 1102 and the expander sleeve 1104, for example by an actuator connected to the expander sleeve 1104. At a predetermined force, the shear pin 1120 may be disengaged, allowing the expander sleeve 1104 to move relative to the mandrel 1102. As the expander sleeve 1104 engages the inner surface of the mandrel 1102, the mandrel 1102 is moved into a diametrically expanded position. The seal elements 1108 is urged into contact with the bore hole 130 to form a fluid-tight seal As the seal body 1140 contacts the bore hole 130, the seal body 1140 changes configuration and occupies a portion of the volume gap in the recess 1115. Additionally, the anti-extrusion devices 1142, 1144 in the seal body 1140 are urged toward an interface between the packer 1100 and the bore hole 130 to block the elastomeric material of the seal body 1140 from flowing into the gap between the packer 1100 and the bore hole 130.

Figure 12B:
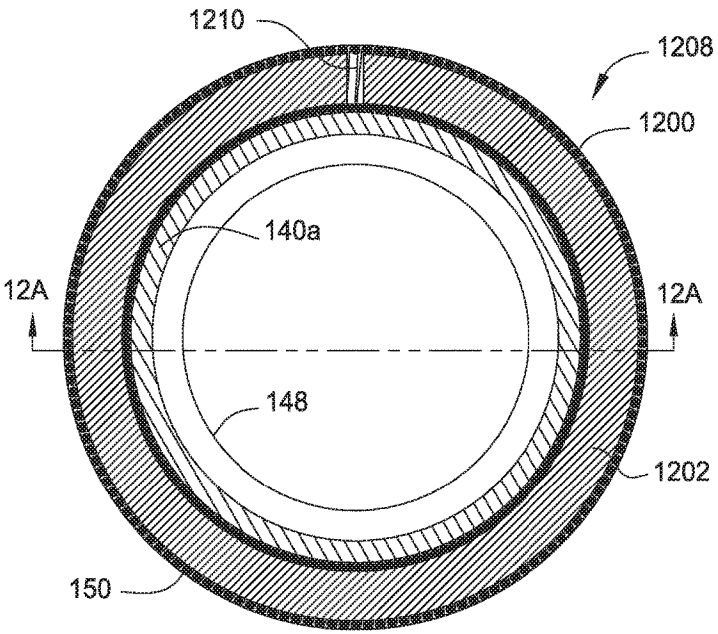
FIG. 12B is a schematic sectional top view of the packing element of FIG. 12A.
Figure 12D:
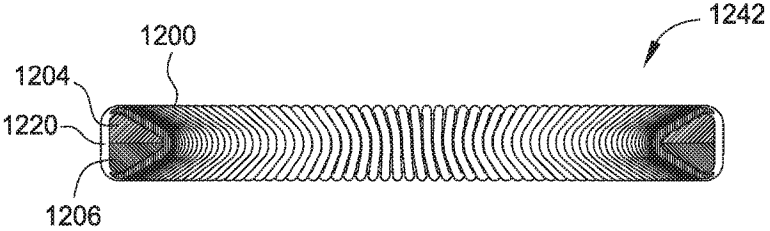
FIG. 12D is a partial sectional view of the anti-extrusion device in FIG. 12C.
Figure 12A:
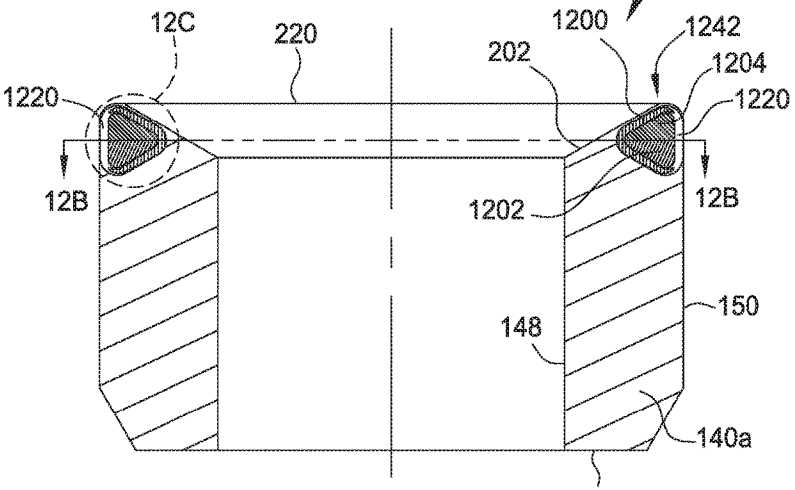
FIG. 12A is a schematic sectional side view of a packing element according to another embodiment of the present disclosure.
Figure 12C:
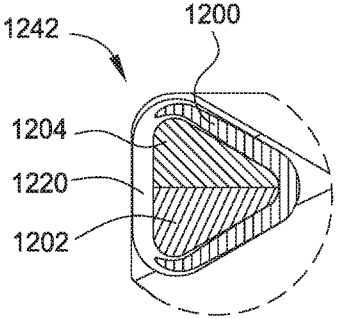
FIG. 12C is a partial enlarged view of the packing element showing an anti-extrusion device in the packing element of the FIG. 12A.

FIG. 12A is a schematic sectional side view of a packing element 1208 according to one embodiment of the present disclosure. FIG. 12B is a schematic sectional top view of the packing element 1208. The packing element 1208 is similar to the packing element 108 of FIG. 2A except that the packing element 1208 includes an anti-extrusion device 1242 having a non-circular sectional view. FIG. 12C is a partial enlarged view of the packing element 1208 showing the anti-extrusion device 1242. FIG. 12D is a partial sectional view of the anti-extrusion device 1242. The anti-extrusion device 1242 is embedded in the body 140*a* at the upper end 220. The anti-extrusion device 1242 includes a garter spring 1200 and support rings 1202, 1204 disposed in the inner volume of the garter spring 1200. Particularly, the garter spring 1200 is a coiled spring connected at opposite ends to form a spring of a circular shape. The garter spring 1200 may be embedded in the body 140*a* and will expand or retract with the body 140*a* as the diameter of the outer surface 150 increases or decreases.

As shown in FIG. 12C, each coil of the garter spring 1200 has a non-circular shape. Particularly, each coil of the garter spring 1200 includes a linear section 1220. When the garter spring 1200 is embedded in the seal body 140*a*, the linear section 1220 may be aligned with the outer surface 150 of the seal body 140*a*. The linear section 1220 increases the contact area between the packing element 1208 and a tubular to be sealed. In the embodiment of FIG. 12C, each coil of the garter spring 1200 has a triangular shape with rounded corners. Alternatively, the coils of the garter spring 1200 may be any shape having a linear section to be positioned along a sealing surface of a packing element. For example, the coils of the garter spring 1200 may have a polygonal shape, a semi-circle shape, a semi-oval shape.

The support rings 1202, 1204 are disposed in the inner volume of the garter spring 1200 to provide support and maintain the shape of the coils of the garter spring 1200. The support rings 1202, 1204 may include an opening or segmented to allow the support rings 1202, 1204 to expand and retract with the seal body 140*a*.

Figure 13A:
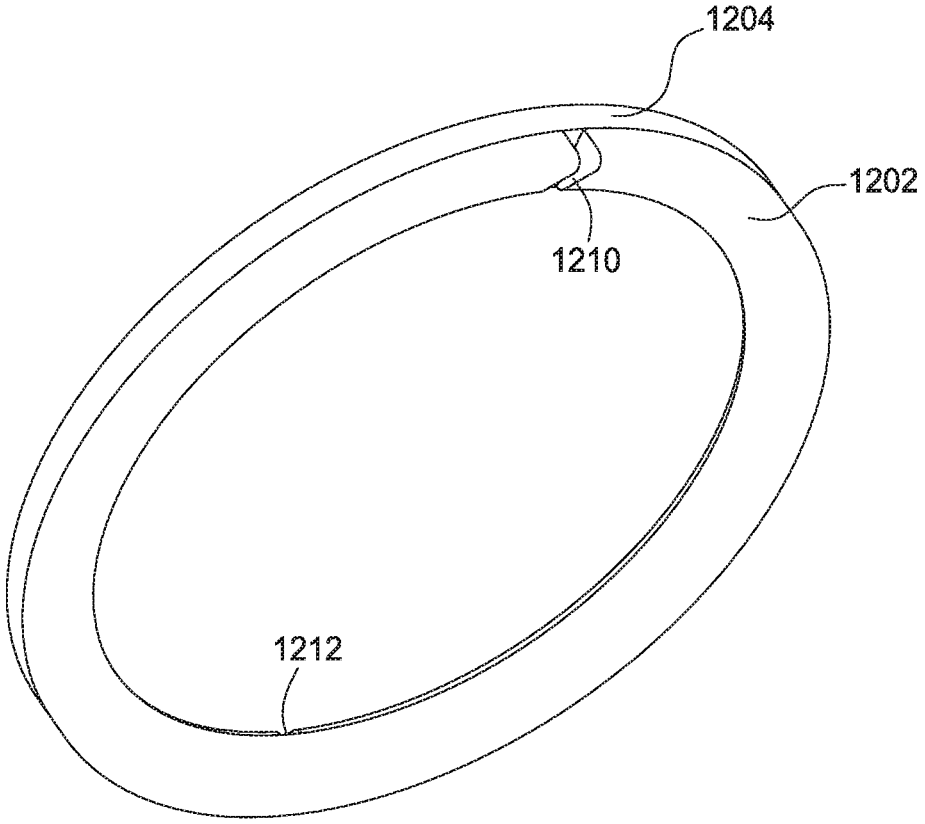
FIG. 13A is a schematic perspective view of a support assembly according to one embodiment of the present disclosure.

FIG. 13A is a schematic perspective view of the support rings 1202, 1204 according to one embodiment of the present disclosure. Each of the support rings 1202, 1204 may be a complete ring having one or more opening 1210, 1212. The support rings 1202, 1204 are stacked together to form a solid ring to fill the inner volume of the garter spring 1200. The openings 1210, 1212 of the support rings 1202, 1204 are positioned in different locations and do not overlap. In one embodiment, the openings 1210, 1212 are positioned at 180 degrees from each other.

Figure 13B:
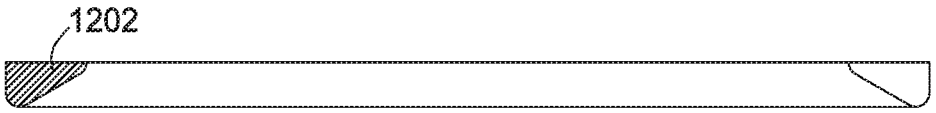
FIG. 13B is a schematic sectional view of a support assembly.

FIG. 13B is a schematic sectional view of the support ring 1202. The support ring 1202 may have a triangular sectional area. In one embodiment, the combined sectional area of the support rings 1202, 1204 form a triangular sectional area filling the inner volume of the garter spring 1200.

The anti-extrusion device 1208 may be used in packing elements of any configuration. For example, the anti-extrusion device 1242 may be used in the packing elements 708, 1108.

Figure 14:
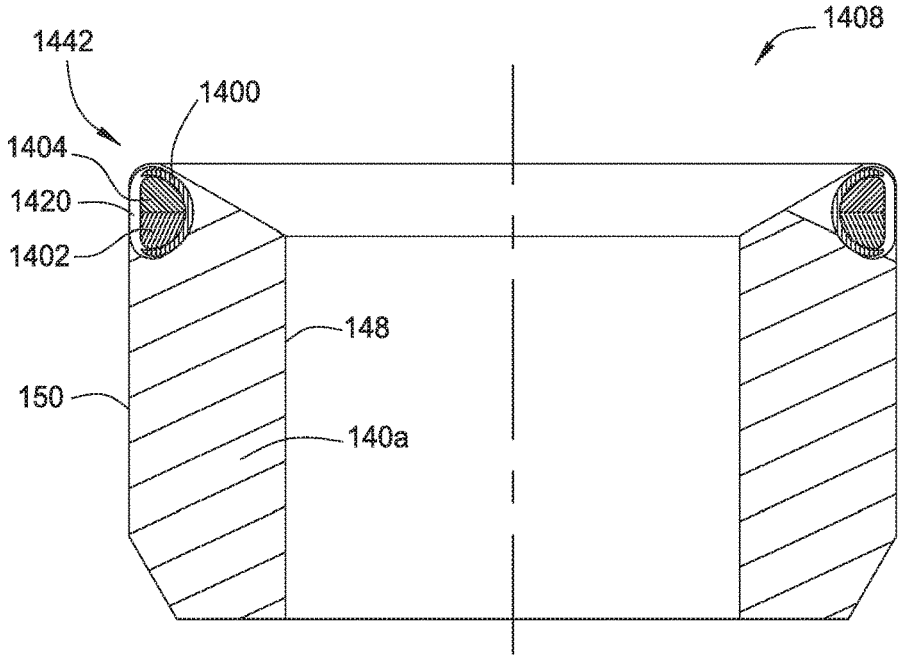
FIG. 14 is a schematic sectional side view of a packing element according to another embodiment of the present disclosure.

FIG. 14 is a schematic sectional side view of a packing element 1408 according to another embodiment of the present disclosure. The packing element 1408 is similar to the packing element 1208 except that the packing element 1408 having an anti-extrusion device 1442 with a semi-circular sectional shape. The anti-extrusion device 1442 include a garter spring 1400 having coils in a semi-circular shape. A linear section 1420 is aligned with the outer surface 150 of the seal body 140*a*. Support rings 1402, 1404 are disposed in the garter spring 1400. Each support ring 1402, 1404 may have a sectional shape of a quarter of a circle.

Figure 15:
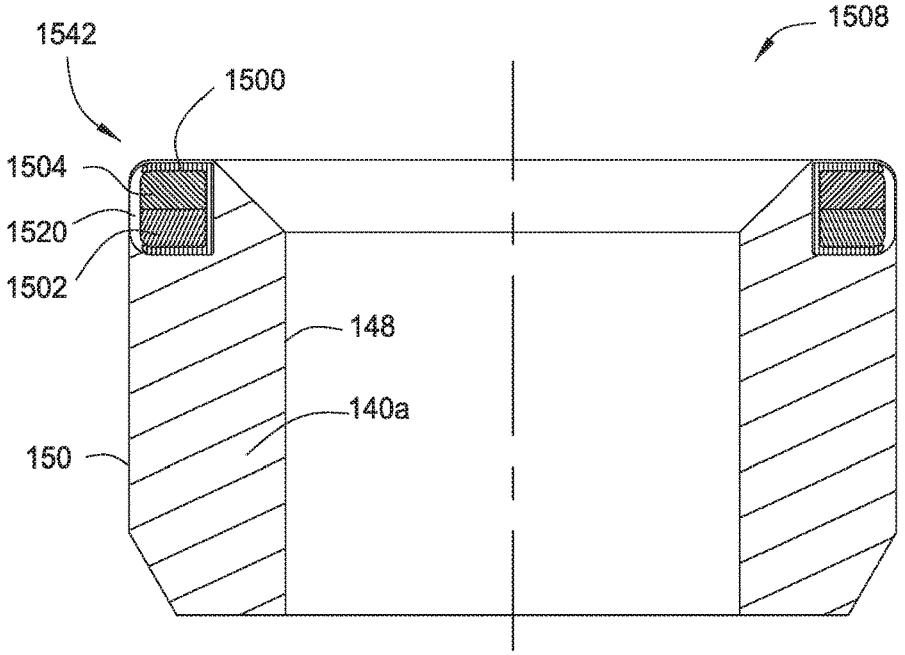
FIG. 15 is a schematic sectional side view of a packing element according to another embodiment of the present disclosure.

FIG. 15 is a schematic sectional side view of a packing element 1508 according to another embodiment of the present disclosure. The packing element 1508 is similar to the packing element 1208 except that the packing element 1508 having an anti-extrusion device 1542 with a rectangular shape. The anti-extrusion device 1542 include a garter spring 1500 having coils in a rectangular shape. A linear section 1520 is aligned with the outer surface 150 of the seal body 140*a*. Support rings 1502, 1504 are disposed in the garter spring 1500. Each support ring 1502, 1504 may have a sectional shape of a rectangular shape.

Embodiments of the present disclosure provide an anti-extrusion device. The anti-extrusion device includes a garter spring and a support member having a ring shaped body disposed in an inner volume of the garter spring. An outer diameter of the ring shaped body varies with extension and retraction of the garter spring without forming a gap through the inner volume of the garter spring.

Embodiments of the present disclosure provide an anti-extrusion device. The anti-extrusion device includes a garter spring having an inner volume; and a support assembly disposed in the inner volume. The support assembly forms a continuous ring shaped body movable between a retracted position and an expanded position, the ring shaped body is a solid ring at the retracted position, and the ring shaped body is a continuous ring having at least two partial openings at different locations at the expanded position.

In one or more embodiment, the support assembly is movable from the retracted position to the extended position and from the extended position to the retracted position.

In one or more embodiments, the support assembly comprises a first ring having at least one first opening to allow an outer diameter of the first ring to expand, and a second ring having area and at least one second opening to allow an outer diameter of the second ring to expand. The first and second rings are stacked together to form the ring shaped body, and at least one of first and second opening is not aligned with each other.

In one or more embodiments, the first ring is a C-ring having one first opening, and the second ring is a C-ring having one second opening.

In one or more embodiments, the first and second openings are positioned about 180 degrees from each other.

In one or more embodiments, the ring shaped body comprises a joined section having a first end and a second end, and a split section having a first portion connected to the first end of the joined section, and a second portion connected to the second end of the joined section.

In one or more embodiments, each of the first portion and the second portion having a semicircular cross sectional area.

In one or more embodiments, the first portion and the second portion are separated by a plane substantially parallel to the ring shaped body.

In one or more embodiments, the first portion and the second portion are separated by a substantially cylindrical surface.

In one or more embodiments, the support assembly is formed from a metal, an elastomer, a plastic, or a thermoplastic.

One or more embodiments of the present disclosure provide a packing element, comprising a tubular body, and an extrusion device disposed on an outer surface of the tubular body. The extrusion device includes a garter spring and a support assembly having a ring shaped body disposed in an inner volume of the garter spring. An outer diameter of the ring shaped body varies with extension and retraction of the garter spring without forming a gap through the inner volume of the garter spring.

In one or more embodiments, the extrusion device is embedded in the tubular body.

In one or more embodiments, the support assembly comprises a first ring having at least one first opening to allow an outer diameter of the first ring to expand, and a second ring having at least one second opening to allow an outer diameter of the second ring to expand. The first and second rings are stacked together to form the ring shaped body, and at least one first and second openings are not aligned with each other.

In one or more embodiments, the first ring is a C-ring having one first opening, and the second ring is a C-ring having one second opening.

In one or more embodiments, the first and second openings are positioned about 180 degrees from each other.

In one or more embodiments, the ring shaped body comprises a joined section having a first end and a second end, and a split section having a first portion connected to the first end of the joined section, and a second portion connected to the second end of the joined section.

In one or more embodiments, each of the first portion and the second portion having a semicircular cross sectional area.

In one or more embodiments, the first portion and the second portion are separated by a plane substantially parallel to the ring shaped body.

In one or more embodiments, the first portion and the second portion are separated by a substantially cylindrical surface.

In one or more embodiments, the support assembly is formed from a metal, an elastomer, a plastic, or a thermoplastic.

One or more embodiments provide a packer comprising a mandrel, a packing element disposed on the mandrel. The packing element includes a tubular body disposed on an outer surface of the mandrel, and an extrusion device disposed on and outer surface of the tubular body. The extrusion device includes a garter spring, and a support assembly having a ring shaped body disposed in an inner volume of the garter spring. An outer diameter of the ring shaped body varies with extension and retraction of the garter spring without forming a gap through the inner volume of the garter spring, and a shoulder member adjacent the packing member.

In one or more embodiments, the shoulder member has a tapered shoulder guiding the packing element radially outward when the packing element is under compression.

While the foregoing is directed to embodiments of the present disclosure, other and further embodiments may be devised without departing from the basic scope thereof, and the scope thereof is determined by the claims that follow.

The invention claimed is:

1. An anti-extrusion device, comprising:

a garter spring; and a support assembly having a ring shaped body disposed in an entire circumference of an inner volume of the garter spring, wherein the ring shaped body expands with expansion of the garter spring while maintaining a continuous ring, and the ring shaped body fills the entire inner volume of the garter spring when the ring shaped body is at a non-expanded position, wherein the ring shaped body comprises:

a first ring having at least one first opening to allow an outer diameter of the first ring to expand; and a second ring having at least one second opening to allow an outer diameter of the second ring to expand, wherein the first and second rings are stacked together to form the ring shaped body, and the at least one first and second openings are positioned at different locations along the ring shaped body.

2. The anti-extrusion device of claim 1, wherein the first ring is a C-ring and the at least one first opening includes one first opening, and the second ring is a C-ring and the least one second opening includes one second opening.

3. The anti-extrusion device of claim 2, wherein the first and second openings are positioned about 180 degrees from each other.

4. The anti-extrusion device of claim 1, wherein the support assembly is formed from a metal, an elastomer, a plastic, or a thermoplastic.

5. An anti-extrusion device, comprising:

a garter spring; and a support assembly having a ring shaped body disposed in an entire circumference of an inner volume of the garter spring, wherein the ring shaped body expands with expansion of the garter spring while maintaining a continuous ring, and the ring shaped body fills the entire inner volume of the garter spring when the ring shaped body is at a non-expanded position, wherein the support assembly comprises an elongated member having opposing ends, the elongated member is formed into a ring shape, and the opposing ends overlap.

6. The anti-extrusion device of claim 5, wherein each of the opposing end has a semicircular cross sectional area.

7. The anti-extrusion device of claim 5, wherein the opposing ends overlap along a plane substantially parallel to the ring shaped body.

8. The anti-extrusion device of claim 5, wherein the opposing ends overlap along a substantially cylindrical surface.

9. The anti-extrusion device of claim 5, wherein the support assembly is formed from a metal, an elastomer, a plastic, or a thermoplastic.

10. A packing element, comprising:

a seal body; and an anti-extrusion device disposed in the seal body, wherein the anti-extrusion device includes:

a garter spring; and a support assembly having a ring shaped body disposed in an entire circumference of an inner volume of the garter spring, wherein the ring shaped body expands with expansion of the garter spring while maintaining a continuous ring, and the ring shaped body fills the entire inner volume of the garter spring when the ring shaped body is at a non-expanded position, wherein the ring shaped body comprises:

a first ring having at least one first opening to allow an outer diameter of the first ring to expand; and a second ring having at least one second opening to allow an outer diameter of the second ring to expand, wherein the first and second rings are stacked together to form the ring shaped body, and the at least one first and second openings are not aligned with each other.

11. The packing element of claim 10, wherein the support assembly is formed from a metal, an elastomer, a plastic, or a thermoplastic.

12. The packing element of claim 10, wherein the first ring is a C-ring and the at least one first opening includes one first opening, and the second ring is a C-ring and the at least one second opening includes one second opening.

13. The packing element of claim 12, wherein the first and second openings are positioned about 180 degrees from each other.

14. A packing element, comprising:

a seal body; and an anti-extrusion device disposed in the seal body, wherein the anti-extrusion device includes:

a garter spring; and a support assembly having a ring shaped body disposed in an entire circumference of an inner volume of the garter spring, wherein the ring shaped body expands with expansion of the garter spring while maintaining a continuous ring, and the ring shaped body fills the entire inner volume of the garter spring when the ring shaped body is at a non-expanded position, wherein the support assembly comprises an elongated member having opposing ends, the elongated member is formed into a ring shape, and the opposing ends overlap.

15. The packing element of claim 14, wherein each of the opposing ends has a semicircular cross sectional area.

16. The packing element of claim 14, wherein the opposing ends overlap along a plane substantially parallel to the ring shaped body.

17. The packing element of claim 14, wherein the opposing ends overlap along a substantially cylindrical surface.

18. The packing element of claim 14, wherein the support assembly is formed from a metal, an elastomer, a plastic, or a thermoplastic.

* * * * *